United States Patent [19]

Bader

[11] 4,450,638

[45] May 29, 1984

[54] PHOTOGRAPH DISPLAY DEVICE

[75] Inventor: Robert Bader, Toronto, Canada

[73] Assignee: Bader Brothers Limited, Toronto, Canada

[21] Appl. No.: 412,414

[22] Filed: Aug. 27, 1982

[30] Foreign Application Priority Data

Sep. 2, 1981 [CA] Canada ..... 385055

[51] Int. Cl.[3] ..... G09F 1/10

[52] U.S. Cl. ..... 40/158 R; 40/124.1; 40/152.1

[58] Field of Search ..... 40/120, 158, 152.1, 40/124.1

[56] References Cited

U.S. PATENT DOCUMENTS

| | | | |
|---|---|---|---|
| 522,484 | 7/1894 | Odgers | 40/159 |
| 630,215 | 8/1899 | Gross | 40/159 |
| 2,782,542 | 2/1967 | Blevens | 40/159 |
| 3,174,244 | 3/1965 | Walton | 40/158 R |
| 3,875,693 | 4/1975 | Pelkey | 40/159 |
| 4,275,517 | 6/1981 | Blanchard | 40/152.1 |

*Primary Examiner*—Gene Mancene
*Assistant Examiner*—Wenceslao J. Contreras
*Attorney, Agent, or Firm*—Rogers, Bereskin & Parr

[57] ABSTRACT

A photograph display device is formed from a generally rectangular strip of cardboard, folded and scored to define a plurality of panels and hinge lines. In a collapsed state the panels provide an envelope for mailing a photograph, and in an erect state, an easel with a rectangular display frame. The easel is supported by a cylindrical base whose ends are scored to permit bevelling relative to the back of the display frame. With the ends bevelled, the device can be oriented in either a first position with the base rested lengthwise on a horizontal surface or a second position substantially 90 degrees rotated relative to the first with either of the bevelled ends of the base rested on a horizontal surface. The device can thus orient a rectangular photograph for proper viewing regardless whether the lengthwise axis of the photograph should be horizontally or vertically oriented.

11 Claims, 7 Drawing Figures

90
70
68
86
58
94
46
44
92
52
50
48
36
28
26
32
56
62
20
88

PHOTOGRAPH DISPLAY DEVICE

FIELD OF THE INVENTION

The invention relates generally to photograph display devices, and in particular provides a collapsible display device constructed of a sheet material such as a cardboard which in a collapsed state provides a photograph mailing envelope and in an erect state provides an easel for displaying a photograph.

DISCUSSION OF THE PRIOR ART

Inexpensive, collapsible photograph display devices have been constructed of sheet materials such as cardboard. In such devices, two sheets of cardboard have been overlaid and secured to provide a rectangular display frame. A cover for the display frame (which cover can also be assembled into a cylindrical base of generally triangular cross-section) has been formed from a rectangular strip of cardboard folded in half to provide front and back cover panels. Two more fold lines, substantially parallel to the first, divide each of the front and back panels into two hinged panel portions of substantially equal area. The cover is located about the display frame with one of the back panel portions secured to the display frame and the other panel portions free to move about the various fold lines. The device can be assembled into a display easel by rotating the unsecured panel portions into a triangular base at the back of the display frame.

A problem associated with such prior art display devices is that any particular device can properly display either a rectangular photograph whose lengthwise axis should be vertically oriented or one whose lengthwise axis should be horizontally oriented, but not both. Thus, a photograph which is best displayed with its lengthwise axis horizontally oriented cannot be properly displayed in a device whose display frame has its lengthwise axis vertically oriented in normal use.

Additionally, to the best of the inventor's knowledge, no such prior art photographic display device has been constructed to provide in a collapsed state an envelope for mailing a photograph which has been located in its display frame.

SUMMARY OF THE INVENTION

Accordingly, in its broadest aspect, the invention provides a display device which can orient a rectangular photograph with its lengthwise axis either horizontally or vertically disposed. The display device comprises a photograph retaining member of generally flat, rectangular shape having a front where a photograph is displayed, a back, a first pair of parallel side edges and a second pair of parallel side edges. An elongate base member is secured lengthwise along one of the first pair of side edges, whereby, when the base member is rested lengthwise on a horizontal surface the second pair of side edges are generally vertically disposed and inclined from vertical towards the base member (as with conventional display devices). At least one end surface of the base member is located adjacent to one of the second pair of side edges, and is bevelled relative to the back of the display member, whereby, the display device can be rested on the bevelled end of the base member and the adjacent side edge, thereby orienting the first pair of side edges in a generally vertical position, inclined from the vertical towards the base member.

Alternatively the ends of the base member can be provided with lines of weakness along which the ends of the base member can be bevelled as required. This is particularly useful where the base member is a hollow cylindrical member with open ends, constructed of cardboard. Score lines can be provided in the cardboard to permit ends of the base member to be tucked into the interior of the base member to provide the required bevelling. In prior art photograph display easels formed of cardboard and provided with a cylindrical base of triangular cross-section, the base has tended to warp or weaken until partially collapsed with time and use. The folding of base end portion represents a marked improvement in that regard, not only bevelling the ends of the base but simultaneously reinforcing the base against warpage or collapse.

In a second aspect, the invention provides a photograph display device constructed from panels of a sheet material which in a collapsed state define an envelope for mailing a photograph and can be erected with the photograph in situ to provide an easel for displaying the photograph.

DESCRIPTION OF THE DRAWINGS

A preferred embodiment of a photograph display device and of a blank for use in constructing the device are illustrated in the drawings, in which.

DESCRIPTION OF A PREFERRED EMBODIMENT

Figure 1:
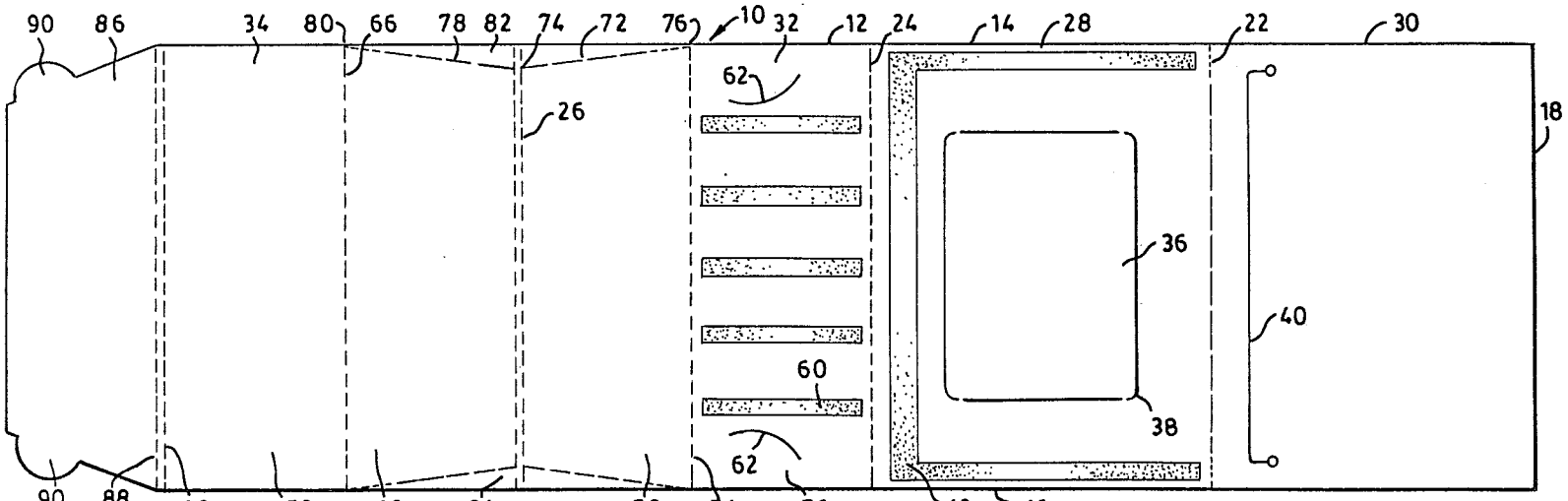
FIG. 1 is a plan view of the blank fully extended.

Reference is made to FIG. 1 which illustrates a blank 10 for use in constructing a photo display device embodying the invention. The blank 10 is die cut from cardboard, folded and scored. Any suitable sheet material may be used provided that the material can be folded to provide hinge lines and scored or perforated to provide lines of weakness.

The blank 10 includes a rectangular strip 12 having first and second longitudinally-directed sides 14, 16, and first and second transverse ends 18, 20 (the second transverse end 20 being defined by a perforated line of weakness).

Fold lines are formed perpendicular to the longitudinally-directed sides 14,16 to define four hingedly connected panels. These fold lines are indicated by the reference numerals 22,24,26 and are hereinafter referred to respectively as the first, second and third "interpanel hinge lines." The panels defined by the hinge lines are arbitrarily designated first, second, third and fourth panels 28,30,32,34. The third interpanel hinge line 26 is illustrated as two stippled lines, indicating that the hinge line has a distinct width (which permits the third panel to be folded about the second interpanel hinge line 24 to sandwich the second panel 30 between itself and the first panel 28).

The first panel 28 has a central portion 36 with a weakened periphery 38. The periphery 38 is die cut through the full thickness of the blank 10 except at connecting webs (not specifically indicated) to permit easy removal by hand. A photograph will be displayed through the opening so defined. If desired, the central portion 36 can be completely removed during die cutting of the blank 10; however, the removable central portion 36 provides a particularily convenient surface for printing instructions or commercial messages, without interfering with the overall appearance of the display device.

The second panel 30 has a die cut slot 40 parallel and adjacent to the first interpanel hinge line 22. The slot 40 is dimensioned to pass a photograph to be displayed in the assembled photo display device. As will be apparent from the drawings, the slot 40 is hidden when the display is in its erect state. However, the slot 40 can be positioned elsewhere, and shaped as desired.

Figure 2:
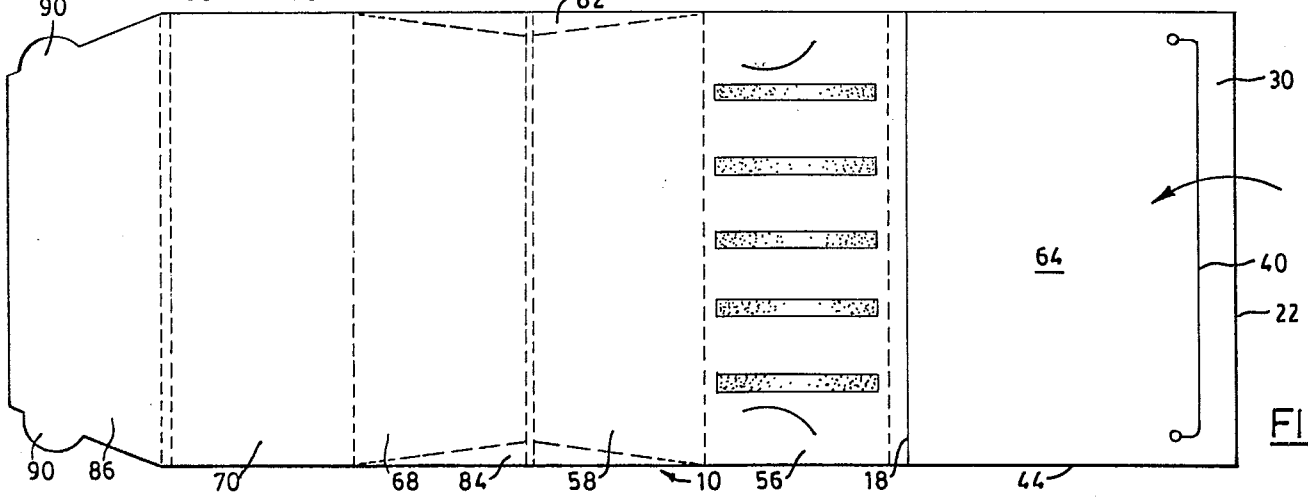
FIG. 2 is a plan view of the blank partially folded during formation of the display device.

The first panel 28 has two elongate surface portions 42 bearing an adhesive which is activated by dampening. The adhesive permits the first and second panels 28, 30 to be secured to one another (as in FIG. 2) to define a flat, rectangular picture frame 44 (well illustrated in FIG. 5). This is done by folding the second panel 30 about the first interpanel hinge line 22 into flat, overlaid engagement with the first panel 28. (To facilitate overlaying, the hinge line 22 is preferably scored). The frame so defined has a first pair of parallel, oppositely disposed side edges 46, 48 and a second pair of parallel, oppositely-disposed side edges 50, 52 (indicated in the views of FIGS. 5–7).

The third panel 32 is folded to define a third panel hinge line 54 substantially parallel to the interpanel hinge lines. The hinge line 54 devides the third panel 32 into first and second third panel portions 56, 58 of substantially identical rectangular shape and area. The first third panel portion 56 bears a plurality of parallel swaths 60 of an adhesive activated by dampening. The swaths 60 extend short of the hinge line 54 so that the second fourth panel portion 70 can be tucked between the first third panel portion 56 and the surface 64 of the second panel 30 when the display device is erected. The first third panel portion also has two arcuate, oppositely disposed slots 62 die cut therein. The function of the adhesive swaths 60 and slots 62 will be described more fully below.

The fourth panel 34 is folded to define a fourth panel hinge line 66 parallel to the interpanel hinge lines. The fourth panel hinge line 66 devides the fourth panel 34 into first and second fourth panel portions 68, 70 of substantially identical rectangular shape and area.

Pairs of lines of weakness are provided in the second third panel portion 58 and the first fourth panel portion 68 at either end of the third interpanel hinge line 26. One pair comprises a first score line 72 extending from a point 74 on the third interpanel hinge line 26 (inset from and adjacent to the first side 14 of the rectangular strip 12) towards the intersection 76 of the third panel hinge line 54 and first side 14. A second score line 78 extends from the point 74 towards the intersection 80 of the fourth panel hinge line 66 and side edge 14. The score lines 72, 78 do not extend fully to the intersections 76, 80 and creases in the cardboard material are substituted therefore adjacent to the intersection 76, 80. (The score lines are indicated by large dashes, the creases by short dashes). The second pair of lines of weakness are constructed and oriented in an analagous manner at the opposite end of the third interpanel hinge line 26.

The lines of weakness enclose two triangular panel portions 82, 84. The score lines ensure that the triangular panel portions 82, 84 can be easily folded about the lines of weakness, while the indentations ensure that the triangular panel portions 82, 84 do not become disengaged from the rectangular strip 12 and blank 10 when assembled into a display device. The triangular panel portions 82, 84 thereafter serve to reinforce ends of a base constructed for the erected display device (in the manner described more fully below).

A fifth panel 86 is integrally formed with the remaining panels of the rectangular strip 12. Its function is to permit the other panels when in a collapsed state to form an envelope (as in FIG. 4). The fifth panel 86 is joined to the fourth panel 34 along the perforated line 20. A fold line 88 is provided parallel and adjacent to the perforated line 20 so that together the lines 20, 88 can define a hinge line of a definite width permitting the fifth panel 86 to be folded about the remaining panels in their collapsed state. Such a feature is not strictly necessary, particularly of the panels 28, 32, 34 are made successively wider from the first end 18, to the second end 20 of the rectangular strip 12. To perform its stated function, the fifth panel 86 is die cut with semicircular tabs 90 insertable into slots 62 of the third panel 32. Alternatively, the fifth panel 86 may be made securable to the third panel 32 by means of a single elongate tab insertable into an elongate slot, an adhesive, buttons fixed to each of the panels and connectable with string, etc.

Figures 3, 4, 5:
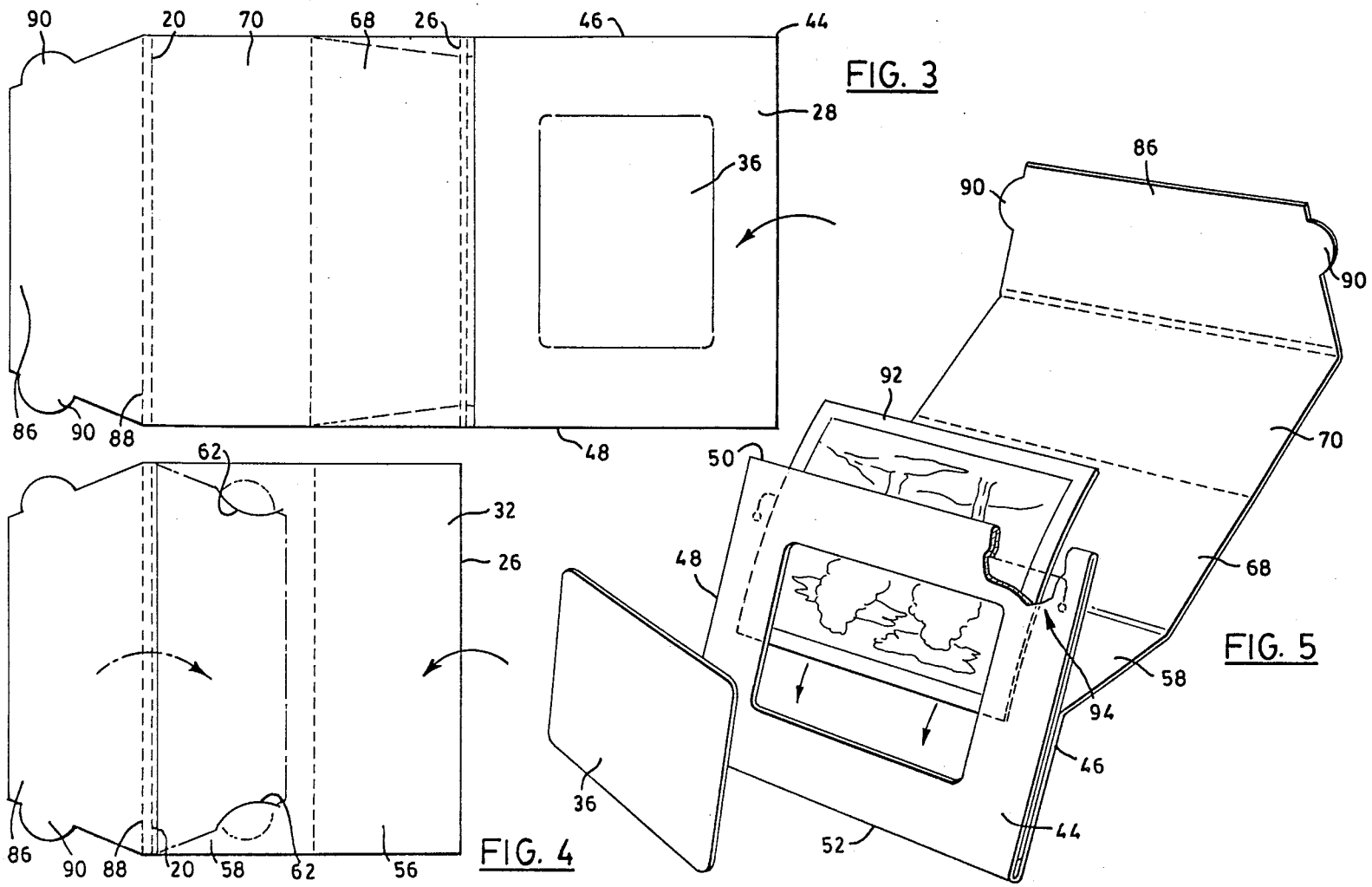
FIG. 3 is a plan view showing the blank fully formed into the display device.
FIG. 4 is a plan view showing the display device in a collapsed state in which it provides an envelope.
FIG. 5 is a plan view illustrating how a photograph is inserted into the display device.

FIG. 3 illustrates the display device in the form in which the device might be sold to bulk users. As mentioned above, and as illustrated in FIG. 2, the first and second panels 28, 30 are first secured to one another to define the picture frame 44. The adhesive swaths 60 are then dampened, and the first third panel portion 56 folded about the second interpanel hinge line 24 into flat, overlaid engagement with the surface 64 (indicated in FIG. 2) of the second panel 30. The second third panel portion 58 remains free to pivot about the third panel hinge line 54.

FIG. 5 illustrates how a rectangular photograph 92 is inserted into the frame 44. The frame 44 is broken away at 94 to show where the photograph 92 is made to enter the slot 40 in the second panel 30. The central portion 36 of the first panel has previously been removed to permit the photograph 92 to viewed from the frame 44.

FIG. 4 illustrates how the display device is folded into an envelope. The frame 44 (with picture contained within) is folded about the third interpanel hinge line 26 (in the direction indicated by an arrow) into flat, overlaid engagement with the fourth panel 34. The fifth panel 86 is then rotated about the perforated line 20 (in the direction indicated by an arrow) into flat, overlaid engagement with the third panel 32, and the tabs 90 inserted into the slots 62 of the first third panel portion 56, as illustrated in ghost outline in FIG. 4. The display device is then in a collapsed state (with the first panel 28 between the second and fourth panels 30,34 and the second panel 30 between the first and third panels 28,32) defining an envelope. The folding arrangement is such that the address on the envelope can be printed on the fourth panel 34 (at the front of the envelope), and then concealed when the display device is erected and located in the first position described below.

Figure 6:
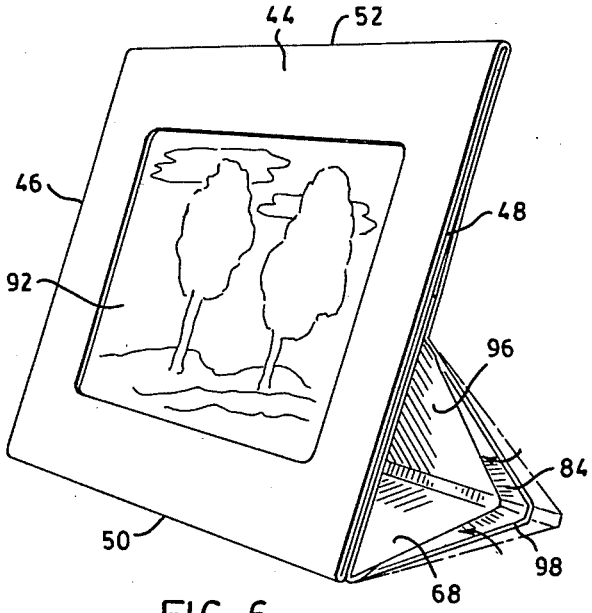
FIG. 6 is a perspective view illustrating the display device resting in a first position; and, FIG. 7 is a perspective view illustrating the display device resting in a second position substantially 90 degrees rotated relative to the first position.

The display is illustrated in its erect state in a first position in FIG. 6. This erect state can be reached from either the partially or totally collapsed states indicated respectively in FIGS. 3 and 4. The device is erected by first removing the fifth panel 86 along the perforated line 20. The second third panel portion 58 and the first and second fourth panel portions 68, 70 are then rotated about the various hinge lines until the second fourth panel portion 70 is in flat, overlaid engagement with the second panel 30, at the back of the frame 44. The second fourth panel portion 70 is tucked into a space left between the first third panel portion 56 and the second panel 30, as apparent in FIG. 6. The second third panel portion 58 and the first and second fourth panel portions 68, 70 then define a cylindrical base 96 of generally triangular cross-section with first and second open ends 98, 100.

The triangular panel portions 82,84 are then tucked into the interior of the base to reinforce and bevel the open base ends 98, 100. In FIG. 6 the position of the triangular panel portion 84 prior to insertion into the interior of the base 98 is indicated in ghost outline, and an arrow indicates the direction in which the panel portion 84 is folded to obtain the final position illustrated in solid lines.

The photograph 92 of FIGS. 5 and 6 is intended to be displayed with its lengthwise axis horizontally oriented. In the first position, illustrated in FIG. 6, the frame side 50 and the base 96 (which extends lengthwise along the side 50) are rested on a horizontal surface, so that the second pair of sides 46, 48 are generally vertically disposed and inclined over the base 96. Consequently, with the display device in the first position the photograph 92 is oriented for proper viewing.

Figure 7:
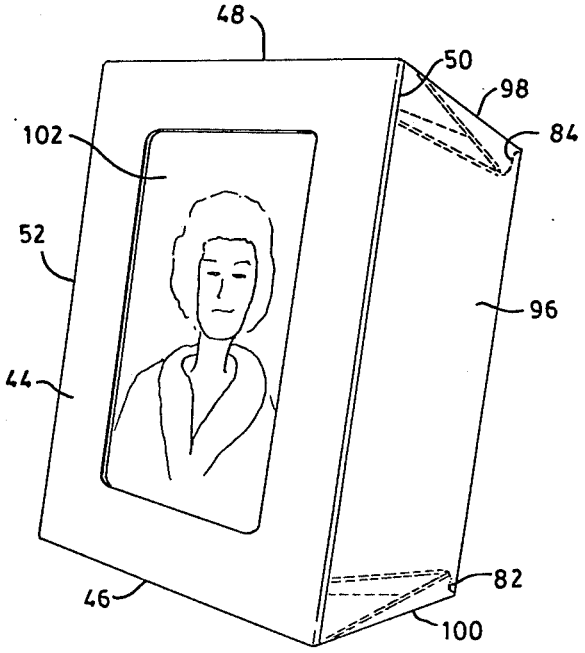

In FIG. 7 a portrait photograph 102, whose lengthwise axis should be vertically oriented, has been installed into the display device. The base end 100 and one side edge 46 of the second pair of side edges adjacent to the base end 100 have been rested on a horizontal surface, thereby causing the first pair of side edges 50, 52 to be substantially vertically oriented and inclined form vertical towards the base 96 because of the bevelling of the base end 100. In this second position, substantially 90 degrees rotated relative to the first position, the display device can properly orient the portrait photograph 102.

Many variations can be effected in the construction of the display device described above. For example, the first and second panels 28, 30 need not be integrally connected, but can be formed from separate pieces of sheet material. The fifth panel 86 could be entirely eliminated of the display device is never intended to be used as an envelope for mailing a photograph. Furthermore, the basic concept of locating a base adjacent to one side edge of a frame and appropriately bevelling the ends of the base can be applied to a variety of display devices, not necessarily formed of sheet materials. Many modifications of a workshop nature can be made in the preferred embodiment disclosed without departing from the scope and spirit of the invention.

I claim:

1. A photograph display device, comprising:

a photograph retaining member of generally flat rectangular shape for displaying a photograph, the photograph retaining member having a front where the photograph is displayed, a back, first pair of oppositely-disposed generally parallel side edges and a second pair of oppositely-disposed generally parallel side edges;

an elongated base member secured to the back of the photograph retaining member, the base member having an elongate side surface and a pair of oppositely-disposed base end portions;

the elongate side surface of the base member being located adjacent to one of the first pair of oppositely-disposed side edges and so contoured that the photograph retaining member is maintained in a first position with the second pair of side edges generally vertically disposed and inclined over the base member when the side surface of the base member is rested on a horizontal surface;

one base end portion being located adjacent to one of the second pair of oppositely-disposed side edges, the one base end portion being so bevelled or formed with lines of weakness to permit the one base end portion to be so bevelled relative to the back of the photograph retaining member, that the photograph retaining member is maintained in a second position in which the first pair of oppositely-disposed side edges are generally vertically disposed and inclined from the vertical towards the base member when the one of the second pair of side edges and the one bevelled base end are located on a horizontal surface.

2. A photograph display device as claimed in claim 1 in which the base member is a generally cylindrical structure having a generally triangular cross-section along a horizontal axis of the base member, the base member having a first side substantially flat against the back of the photograph retaining member, second and third sides angled relative to the back surface of the photograph retaining member and open ends, one end located substantially at each of the second pair of oppositely-disposed side edges.

3. A photograph display device as claimed in claim 2 in which each open end of the base member is bevelled relative to the back of the picture retaining member so that the photograph retaining member is maintained with the first pair of oppositely-disposed side edges generally vertical and inclined from the vertical towards the base member when either of the second pair of oppositely-disposed side members and the open end of the base member at that one of the second pair of oppositely-disposed side members are located on a horizontal surface.

4. A photograph display device as claimed in claim 2 in which the base member is constructed of sheet material and the second and third sides of the base member are provided with score lines adjacent the open ends of the base member whereby the open ends can be bevelled by folding portions of second and third sides along the score lines into the base member so that the base member is maintained with the first pair of oppositely-disposed side edges generally vertically disposed and inclined from the vertical towards the base member when either of the second pair of sides and the open end of the base member at that one of the second pair of oppositely-disposed are located on a horizontal surface.

5. A photograph display device constructed of sheet material, comprising:

first, second, third and fourth panels of generally rectangular shape;

the first and second panels overlaid and secured to one another about edges thereof to define a flat rectangular frame for displaying a photograph, having a first pair of oppositely-disposed generally parallel side edges and a second pair of oppositely-disposed generally parallel side edges, the frame having a slot for receiving a photograph and the first panel having either an opening or a first panel portion with a periphery weakened for removal to display a photograph;

the third panel having first and second third panel portions hingedly connected at a third panel hinge line, the first third panel portion secured to the second panel in flat overlaid engagement, the second third panel portion rotatable about the third panel hinge line;

the fourth panel having first and second fourth panel portions hingedly connected at a fourth panel hinge line, the first fourth panel portion and second third panel portion hingedly connected at an interpanel hinge line;

the second third panel portion and the first and second fourth panel portions being so rotatable about the interpanel hinge line and the third and fourth panel hinge lines that the panels can be moved from a collapsed state in which the panels define a generally flat rectangular structure with the first panel between the second and fourth panels and the second panel between the first and third panels to an erect state in which the second third panel portion and the first and second fourth panel portions together define a generally cylindrical base of generally triangular cross-section with the second fourth panel portion located in substantially flat overlaid engagement with the second panel and with the second third portion and first fourth panel portion angled relative to the second panel, the triangular base having a pair of open ends, one open end at each of the second pair of oppositely-disposed side edges of the frame;

the second third panel portion and the first fourth panel portion having edge portions adjacent each end of the interpanel hinge line either so shaped or provided with lines of weakness along which the edge portions can be so shaped that in the erect state the ends of the base are bevelled relative to the second panel or can be bevelled relative to the second panel by displacing edge portions of the second third panel portion and first fourth panel portion along the lines of weakness respectively, whereby the frame is oriented with the first pair of side edges generally vertically disposed and inclined from the vertical towards the base when either of the second pair of oppositely-disposed side edges and the open base end at that side edge are located on a horizontal surface.

6. A photograph display device as claimed in claim 5 comprising a fifth panel integrally connected to the second fourth panel portion along an interpanel line of weakness, the fifth line of weakness permitting the fifth panel to be rotated into flat engagement with the third panel when the first, second, third and fourth panels are in the collapsed state, the fifth panel including means for securing the fifth panel to the third panel when located in flat engagement with the third panel, the interpanel line of weakness also permitting the fifth panel to be detached from the fourth panel prior to placing the first, second, third and fourth panels into the erect state.

7. A photograph display device as claimed in claim 6 in which the second third panel portion comprises a slit and the securing means of the fifth panel comprise a tab insertable into the slit.

8. The device of claim 5, 6 or 7 in which the edge portions of the second third panel portion and the first fourth panel portion are shaped to define a generally triangular indentation at each end of the interpanel hinge line in the collapsed condition thereby providing the bevelled ends of the base in the erect condition.

9. The device of claim 5, 6 or 7 in which lines of weakness in the edge portions of the second third panel portion and the first fourth panel portion define a generally triangular edge portion at each end of the interpanel hinge line in the collapsed state thereby permitting the base ends to be bevelled by deflection of the triangular edge portions into the base.

10. A blank for use in constructing a photograph display device, comprising:

a generally rectangular strip of sheet material with first and second longitudinally-directed sides and first and second transverse ends;

three interpanel hinge lines generally perpendicular to the sides of the rectangular strip, the first interpanel hinge line spaced from the first end of the rectangular strip, the second interpanel hinge line further spaced from the first end of the rectangular strip, and the third interpanel hinge line furthest spaced from the first end of the rectangular strip;

the three interpanel hinge line defining four generally rectangular, hingedly connected panels, namely, a first panel between the first and second interpanel hinge line, a second panel between the first end of the rectangular strip and the first interpanel hinge line, a third panel between the second and third interpanel hinge lines and a fourth panel between the third interpanel hinge line and the second end of the rectangular strip;

the interpanel hinge lines so spaced from the first end of the rectangular strip that the panels can be placed in a collapsed state in which the panels define a generally flat rectangular structure with the first panel between the second and fourth panels and the second panel between the first and third panels;

the first panel having either a centrally located opening or a central portion with a periphery weakened for removal to define an opening;

the second panel having a slit generally perpendicular to the sides of the rectangular strip and adjacent to the first interpanel hinge line;

third and fourth panel hinge lines generally perpendicular to the sides of the rectangular strip, the third panel hinge line deviding the third panel into first and second hingedly connected third panel portions, the fourth panel hinge line deviding the fourth panel into first and second hingedly connected fourth panel portions;

a first line of weakness extending substantially from a first point on the third interpanel hinge line generally inset from and adjacent to the first side of the rectangular strip generally towards the intersection of the third panel hinge line and the first side of the rectangular strip;

a second line of weakness extending substantially from the first point on the third interpanel hinge line generally towards the intersection of the fourth panel hinge line and the first side of the rectangular strip;

a third line of weakness extending substantially from a second point on the third interpanel hinge line generally inset from and adjacent to the second side of the rectangular strip generally towards the intersection of the third panel line and the second side of the rectangular side; and, a fourth line of weakness extending substantially from the second point on the third interpanel hinge line generally towards the intersection of the fourth panel hinge line and the second side of the rectangular strip.

11. A blank as claimed in claim 10 further comprising a fifth panel integrally connected to the fourth panel along a fifth line of weakness which fifth line of weakness extends along the second end of the rectangular strip, the fifth line of weakness permitting the fifth panel to be rotated around the second interpanel hinge line into flat engagement with the third panel when the first, second, third and fourth panels are placed into the collapsed state, the fifth panel having a tab and the second third panel portion having a slot for receiving the tab when the fifth panel is placed into the flat engagement with the third panel, the line of weakness also permitting the fifth panel to be detached from the fourth panel.

* * * * *